US008447579B2

(12) United States Patent
Sayers et al.

(10) Patent No.: US 8,447,579 B2
(45) Date of Patent: May 21, 2013

(54) METHOD AND SYSTEM FOR PORE PRESSURE PREDICTION

(75) Inventors: Colin Michael Sayers, Katy, TX (US); Lennert David den Boer, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/176,063

(22) Filed: Jul. 5, 2011

(65) Prior Publication Data

US 2011/0264431 A1 Oct. 27, 2011

Related U.S. Application Data

(62) Division of application No. 11/834,554, filed on Aug. 6, 2007, now Pat. No. 7,996,199.

(60) Provisional application No. 60/836,099, filed on Aug. 7, 2006.

(51) Int. Cl.
*G06G 7/48* (2006.01)

(52) U.S. Cl.
USPC ..... 703/10

(58) Field of Classification Search
USPC ..... 703/10
See application file for complete search history.

(56) References Cited

PUBLICATIONS

Foreign Search report, Parent application 11834554; Jan. 15, 2008; pp. 1-3.*

* cited by examiner

*Primary Examiner* — Hugh Jones
(74) *Attorney, Agent, or Firm* — Colin Wier

(57) ABSTRACT

A method for performing an oilfield operation at a wellsite having a drilling rig configured to advance a drilling tool into a subsurface formation. The method includes generating a borehole temperature model for an area of interest using water depth information and a vertical stress model, generating a formation temperature model using the borehole temperature model, generating a mud-weight pressure model using the formation temperature model and pressure coefficients, generating a formation pore pressure model using the mud-weight pressure model, and adjusting the oilfield operation based on the formation pore pressure model.

35 Claims, 5 Drawing Sheets

METHOD AND SYSTEM FOR PORE PRESSURE PREDICTION

CROSS-REFERENCE TO RELATED APPLICATIONS

This application is a divisional of U.S. patent application Ser. No. 11/834,554, filed on Aug. 6, 2007, and entitled: "METHOD AND SYSTEM FOR PORE PRESSURE PREDICTION," under 35 U.S.C. §121. Further, this application claims priority from U.S. Provisional Patent Application No. 60/836,099 entitled "Method, Apparatus and System for Pore Pressure Prediction from Temperature and Vertical Stress," filed Aug. 7, 2006, in the names of Colin Michael Sayers and Lennert David den Boer, the entire contents of which are incorporated herein by reference.

BACKGROUND

An accurate estimate of formation pore pressure is a key requirement for the safe and economic drilling in overpressured sediments. Conventional methods of predicting pre-drill pore pressures are based on use of seismic velocities together with a velocity-to-pore-pressure transform, calibrated to offset well data (See, e.g., Sayers, C. M., Johnson, G. M. and Denyer, G., 2002, "Pre-drill Pore Pressure Prediction Using Seismic Data," *Geophysics,* 67, pp. 1286-1292). However, these methods depend on the availability of accurate pre-drill seismic velocities.

A pre-drill estimate of formation pore pressures can be estimated either by using offset wells directly, or by using these to determine a velocity-to-pore-pressure transform, and then applying this transform to seismic velocities at the proposed well location. Examples of such transforms include the method of Eaton, which is described in "The Equation for Geopressure Prediction from Well Logs" SPE 5544 (*Society of Petroleum Engineers of AIME,* 1975), and that of Bowers, which is described in "Pore pressure estimation from velocity data: Accounting for pore-pressure mechanisms besides under compaction," *SPE Drilling and Completion* (June 1995), pp. 89-95. These predictions can be updated while drilling the well, using Measurements While Drilling (MWD), Logging While Drilling (LWD), or other drilling data.

Previous studies based on x-ray diffraction (XRD) analysis of Gulf of Mexico data (Holbrook, 2002, "The primary controls over sediment compaction," *AAPG Memoir,* 76) have suggested that transformation of the clay mineral Smectite into Illite may be associated with the onset of over-pressure (Dutta, N. C., 2002, "Geopressure prediction using seismic data: current status and the road ahead," *Geophysics,* 67). This diagenetic process is primarily dependent upon potassium concentration and temperature, and is believed to occur within a relatively narrow temperature range (175±25° F.). It is typically characterized by a sigmoidal relationship between temperature and mineralogy indicators like grain density, with an inflection point occurring at the approximate Smectite-Illite conversion temperature (Lopez, J. L, Rappold, P. M., Ugueto, G. A., Wieseneck, J. B, Vu, C. K., 2004, "Integrated shared earth model: 3D pore-pressure prediction and uncertainty analysis," *The Leading Edge,* 23, pp. 52-59).

FIG. 1 shows an exemplary diagram of an oilfield operation. Those skilled in the art will appreciate that the oilfield operation shown in FIG. 1 is provided for exemplary purposes only and accordingly should not be construed as limiting the scope of the invention. For example, the oilfield operation shown in FIG. 1 is a seafloor oilfield operation, but the oilfield operation may alternatively be a land oilfield operation or any other type of oilfield operation involved in the exploration, extraction, and/or production of fluids from a subterranean formation.

As shown in FIG. 1, a drilling rig (105) is configured to drill into a formation (e.g., a subterranean formation below a seafloor (115)) using a drill bit (not shown) coupled to the distal end of a drill string (125). Specifically, the drill bit is used to drill a borehole (130) extending to an area of interest (120). The area of interest (120) may be hydrocarbon, a mineral resource, or fluid targeted by an oilfield operation. Water depth may correspond to the vertical distance between the sea surface (110) and the seafloor (115). Subsurface vertical depth may correspond to the vertical distance between the sea surface (110) and the area of interest (120). Further, the subsurface (not shown) above the area of interest (120) may be referred to as overburden. The overburden may include soil and materials of varying densities.

When sediment of low permeability substance is buried or compacted, fluid may be trapped in pores within the resulting structure (i.e., within the low permeability substance itself and/or within substances beneath the low permeability substance (e.g., sand, etc.). Fluid trapped in this manner exerts pressure on the surrounding formation referred to as pore pressure. Formations in which pore pressure exceeds hydrostatic pressure at a given depth are referred to as overpressured.

When drilling in an overpressured formation, the mud weight (i.e., the weight of drilling fluids transmitted to the borehole) must be high enough to prevent the pore pressure from moving formation fluids into the borehole. In the worst case, formation fluids entering a borehole may result in loss of the well and/or injury to personnel operating the drilling rig. Accordingly, for safe and economic drilling, it is essential that the pore pressure be predicted (and monitored) with sufficient accuracy. In particular, it is beneficial to predict pore pressure pre-drill, i.e., either before any drilling has commenced and/or at a location that the drill bit has not yet reached.

Conventionally, pre-drill pore pressure prediction is based on the use of pre-drill seismic velocities and a velocity-to-pore pressure transform calibrated using offset well data (i.e., data from other wells near the drilling site). However, in some cases (e.g., when drilling under salt), conventional pre-drill pore pressure predictions may not be sufficiently accurate. Further discussion of conventional pre-drill pore pressure prediction techniques can be found in Sayers C M, Johnson G M, and Denyer G., 2002, "Pre-drill Pore Pressure Prediction Using Seismic Data," *Geophysics,* 67, pp. 1286-1292.

Mud is used in oilfield operations to cool the drill bit, to transport cuttings generated by the oilfield operation to the surface, to prevent the influx of formation fluids into the borehole, and to stabilize the borehole. With respect to preventing the influx of formation fluids, the drilling operator must maintain the mud weight at or above the pore pressure. With respect to stabilizing the borehole, drilling operators adjust the mud weight (i.e., the density of the mud being used) to counter the tendency of the borehole to cave in. However, the drilling operator must be careful not to fracture the formation by using an excessively high mud weight.

Moreover, too high a mud weight may result in an unacceptably low drilling rate. Accordingly, the mud weight must be low enough to maintain an acceptable drilling rate and avoid fracturing the formation. In such cases, the allowable mud weight window (i.e., the range of allowable mud weights) may be small when drilling in overpressured formations. Specifically, the force exerted by the mud must fall within the range between the pore pressure (or the pressure to prevent a cave in, if higher than the pore pressure) and the pressure required to fracture the formation.

Further, when drilling in overpressured formations, the number of required casing strings (i.e., structural supports inserted into the borehole) may be increased. Specifically, if a sufficiently accurate pre-drill pore pressure prediction is not available, additional casing strings may be inserted prematurely, to avoid the possibility of well control problems (e.g., influx of formation fluids) and/or borehole failure. Prematurely inserting casing strings may delay the oilfield operation and/or reduce the size of the borehole and result in financial loss.

SUMMARY

In general, in one aspect, the invention relates to a method for performing an oilfield operation at a wellsite having a drilling rig configured to advance a drilling tool into a subsurface formation. The method includes generating a borehole temperature model for an area of interest using water depth information and a vertical stress model, generating a formation temperature model using the borehole temperature model, generating a mud-weight pressure model using the formation temperature model and pressure coefficients, generating a formation pore pressure model using the mud-weight pressure model, and adjusting the oilfield operation based on the formation pore pressure model.

In general, in one aspect, the invention relates to a method for predicting formation pore pressure. The method includes generating a borehole temperature model for an area of interest using water depth information and a vertical stress model, generating a formation temperature model using the borehole temperature model, generating a mud-weight pressure model using the formation temperature model and pressure coefficients, generating a formation pore pressure model using the mud-weight pressure model, and obtaining a proposed well plan based on the formation pore pressure model, wherein the proposed well plan is used to perform an oilfield operation.

In general, in one aspect, the invention relates to a system for performing an oilfield operation at a wellsite having a drilling rig configured to advance a drilling tool into a subsurface formation. The system includes a temperature module configured to generate a borehole temperature model for an area of interest using water depth information and a vertical stress model, and generate a formation temperature model using the borehole temperature model. The system further includes a pressure module configured to generate a mud-weight pressure model using the formation temperature model and pressure coefficients, and generate a formation pore pressure model using the mud-weight pressure model. The system further includes a surface unit configured to adjust the oilfield operation based on the formation pore pressure model.

In general, in one aspect, the invention relates to a modeling system. The system includes a temperature module configured to generate a borehole temperature model for an area of interest using water depth information and a vertical stress model, and generate a formation temperature model using the borehole temperature model. The system further includes a pressure module configured to generate a mud-weight pressure model using the formation temperature model and pressure coefficients, and generate a formation pore pressure model using the mud-weight pressure model. The system further includes a modeling unit configured to obtain a proposed well plan based on the formation pore pressure model, wherein the proposed well plan is used to perform an oilfield operation.

In general, in one aspect, the invention relates to a computer program product embodying instructions executable by the computer to perform method steps for performing an oilfield operation at a wellsite having a drilling rig configured to advance a drilling tool into a subsurface, the instructions comprising functionality to generate a borehole temperature model for an area of interest using water depth information and a vertical stress model, generate a formation temperature model using the borehole temperature model, generate a mud-weight pressure model using the formation temperature model and pressure coefficients, generate a formation pore pressure model using the mud-weight pressure model, and adjust the oilfield operation based on the formation pore pressure model.

In general, in one aspect, the invention relates to a computer program product, embodying instructions executable by the computer to perform method steps for obtaining a proposed well plan, the instructions comprising functionality to generate a borehole temperature model for an area of interest using water depth information and a vertical stress model, generate a formation temperature model using the borehole temperature model, generate a mud-weight pressure model using the formation temperature model and pressure coefficients, generate a formation pore pressure model using the mud-weight pressure model, and obtain the proposed well plan based on the formation pore pressure model, wherein the proposed well plan is used to perform an oilfield operation.

Other aspects of the invention will be apparent from the following description and the appended claims.

DETAILED DESCRIPTION

Figure 1:
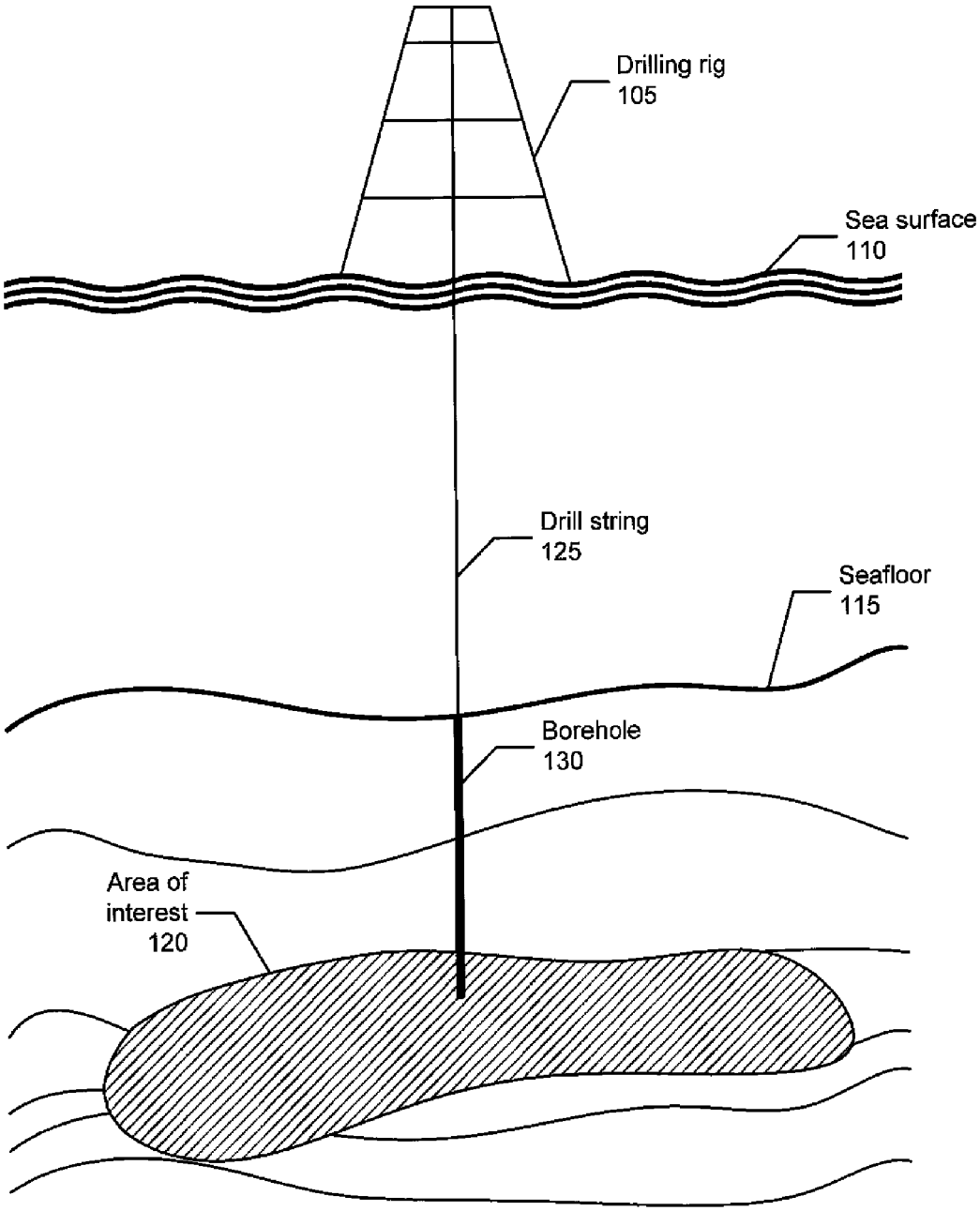
FIGURE 1 (PRIOR ART)
FIG. 1 shows an exemplary diagram of an oilfield operation.

Specific embodiments of the invention will now be described in detail with reference to the accompanying figures. Like elements in the various figures are denoted by like reference numerals for consistency. Further, "ST" may be used to denote "Step."

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, embodiments of the invention provide a method and system for obtaining an optimal well design. Specifically, a formation pore pressure model is generated using a formation temperature model. In one or more embodiments of the invention, the formation temperature model is generated using a borehole temperature model. An optimal well design is obtained based on the formation pore pressure model.

Figure 2:
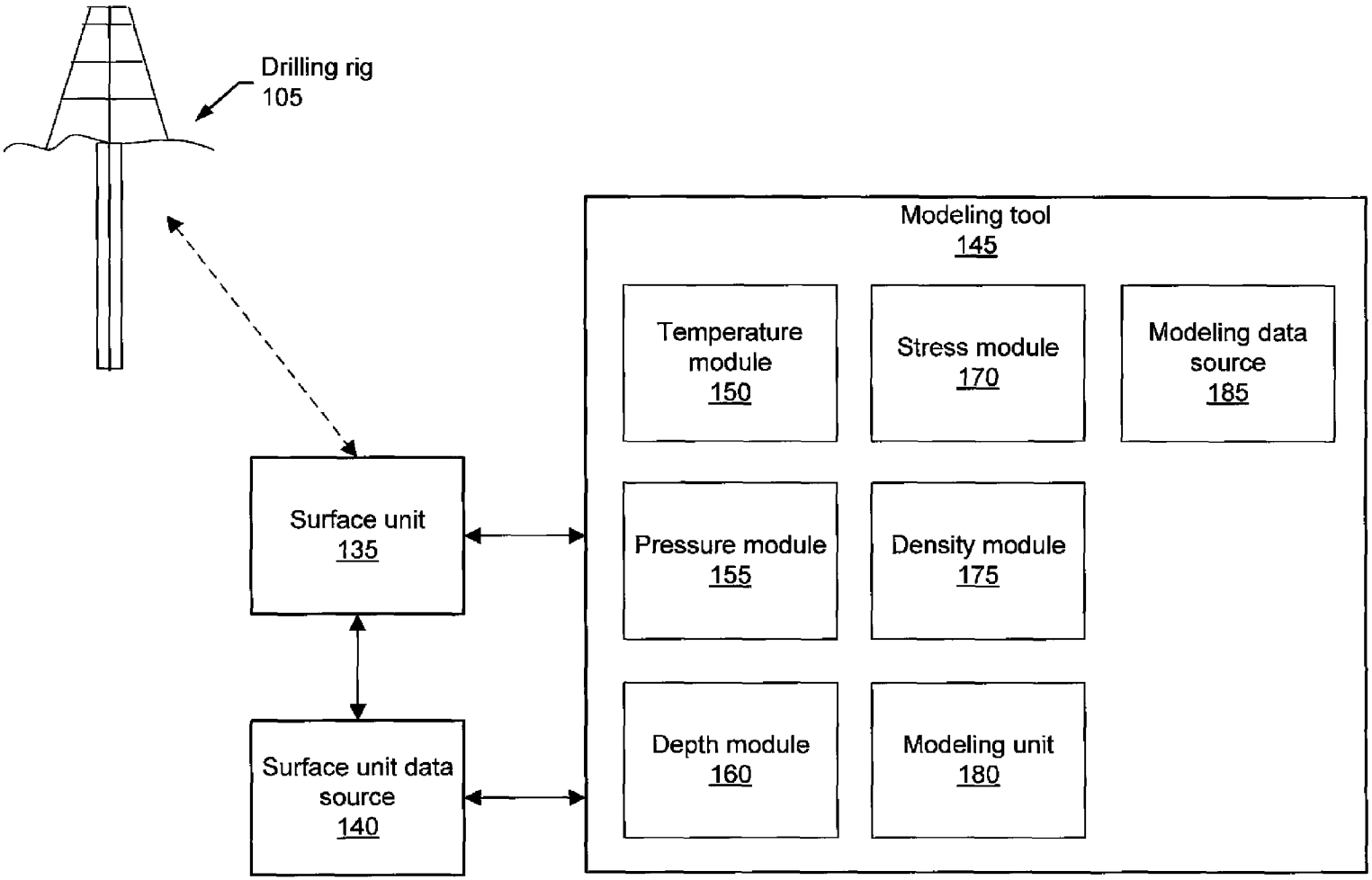
FIG. 2 shows a diagram of a system in accordance with one or more embodiments of the invention.

FIG. 2 is a schematic view of a system for obtaining an optimal well design. The system includes a modeling tool (145) configured to interact with a surface unit (135) and a surface unit data source (140). The surface unit (135) is configured to interact with a surface unit data source (140). Optionally, the surface unit (135) may be further configured to interact with a drilling rig (105). In one embodiment of the invention, the modeling tool (145) further includes a temperature module (150), a pressure module (155), a depth module (160), a stress module (170), a density module (175), a modeling unit (180), and a modeling data source (185). Each of the aforementioned components of FIG. 2 is described below.

Optionally, in one or more embodiments of the invention, the surface unit (135) may be configured to interact with the drilling rig (105). More specifically, the surface unit (135) may be configured to store data obtained at/from the drilling rig (105). For example, the surface unit (135) may store data collected at sensors (not pictured) located at (or operatively connected to) the drilling rig (105). In one or more embodiments of the invention, the surface unit (135) may store data in the surface unit data source (140). In one or more embodiments of the invention, the surface unit data source (140) is a data store (e.g., a database, a file system, one or more data structures configured in a memory, an extensible markup language (XML) file, some other method of storing data, or any suitable combination thereof), which may include information related to the drilling rig (105).

In one or more embodiments of the invention, the surface unit (135) may be configured to adjust oilfield operations at the drilling rig (105). More specifically, in one or more embodiments of the invention, the surface unit (135) may be configured to adjust a drilling fluid density (i.e., increasing or decreasing the drilling fluid density, for example mud density, as appropriate), adjust a drilling trajectory (e.g., to avoid an overpressured area, to pass through a low-pressure area, etc.), optimize the number of casing strings in the borehole (i.e., adding a casing string, delaying addition of a casing string, etc.), or any other similar type of adjustment.

In one or more embodiments of the invention, the modeling tool (145) may be configured to interact with the surface unit (135). More specifically, in one or more embodiments of the invention, the modeling tool (145) may be configured to receive data from the surface unit (135). For example, the modeling tool (145) may be configured to receive data associated with the drilling rig (105) from the surface unit (135). Alternatively, the modeling tool (145) may be configured to retrieve data from the surface unit data source (140).

In one or more embodiments of the invention, the pressure module (155) is configured to generate pressure models (e.g., mud-weight pressure model, formation pore pressure model, etc.). In one or more embodiments of the invention, a mud-weight pressure model corresponds to a model describing estimated mud-weight pressures for an area of interest. In one or more embodiments of the invention, a formation pore pressure model corresponds to a model describing estimated formation pore pressures for an area of interest. Further, in one or more embodiments of the invention, the pressure module (155) interacts with the modeling unit (180) to obtain a model for an area of interest. In this case, a pressure model may be obtained using the model for the area of interest. In one or more embodiments of the invention, the pressure module (155) is configured to receive pressure information from the surface unit (135). Alternatively, the pressure module (155) may be configured to obtain pressure information from the surface unit data source (140).

In one or more embodiments of the invention, the pressure module (155) is configured to generate pressure coefficients. In one or more embodiments of the invention, the pressure coefficients represent the correlation between formation temperature and formation pore pressure. In one or more embodiments of the invention, the pressure module (155) is configured to obtain formation temperature models from the temperature module (150).

In one or more embodiments of the invention, the temperature module (150) is configured to generate temperature models (e.g., borehole temperature model, formation temperature model, etc.). In one or more embodiments of the invention, a borehole temperature model corresponds to a model describing estimated borehole temperatures across an area of interest. In one or more embodiments of the invention, a formation temperature model corresponds to a model describing estimated formation temperatures across an area of interest. Further, in one or more embodiments of the invention, the temperature module (150) interacts with the modeling unit (180) to obtain a model for an area of interest. In this case, a temperature model may be obtained using the model for the area of interest. In one or more embodiments of the invention, the temperature module (150) may be configured to receive temperature information from the surface unit (135). Alternatively, the temperature module (150) may be configured to obtain temperature information from the surface unit data source (140).

In one or more embodiments of the invention, the temperature module (150) is configured to generate temperature coefficients. In one or more embodiments of the invention, the temperature coefficients represent the correlation between vertical stress and borehole temperature. In one or more embodiments of the invention, the temperature module (150) is configured to obtain vertical stress models from the stress module (170).

In one or more embodiments of the invention, the temperature module (150) is configured to identify subsets of a formation temperature model. More specifically, the temperature module (150) may be configured to identify a subset of a formation temperature model based on criteria.

In one or more embodiments of the invention, the stress module (170) is configured to generate vertical stress models. In one or more embodiments of the invention, a vertical stress model corresponds to a model describing vertical stress for an area of interest. Further, in one or more embodiments of the invention, the stress module (170) interacts with the modeling unit (180) to obtain a model for an area of interest. In this case, a vertical stress model may be obtained using the model for the area of interest. In one or more embodiments of the invention, the stress module (170) is configured to obtain density models from the density module (175).

In one or more embodiments of the invention, the density module (175) is configured to generate density models. In one or more embodiments of the invention, a density model corresponds to a model describing estimated density for an area of interest. Further, in one or more embodiments of the invention, the density module (175) interacts with the modeling unit (180) to obtain a model for an area of interest. In this case, a density model may be obtained using the model for the area of interest. In one or more embodiments of the invention, the density module (175) may be configured to receive density information from the surface unit (135). Alternatively, the density module (175) may be configured to obtain density information from the surface unit data source (140).

In one or more embodiments of the invention, the modeling unit (180) is configured to obtain a proposed well plan. More specifically, the modeling unit may be configured to obtain a proposed well plan based on the model(s) (e.g., a formation temperature model, a formation pore pressure model, etc.). In one or more embodiments of the invention, the proposed well plan includes, but is not limited to, a location to commence drilling on the seafloor, a trajectory of a proposed well at the location, a number of casing to use while drilling the well, the location at which each of the casing should be inserted into the well, the mud weight density (densities) to use while drilling the well, and the locations in the area of interest to avoid (for example, because the locations are over pressured) while drilling.

In one or more embodiments of the invention, the depth module (160) is configured to provide water depth information to the density module (175), the stress module (170), the pressure module (155), and/or the temperature module (150). More specifically, the depth module (160) may be configured to provide the water depth at a particular location on the seafloor (115 in FIG. 1).

Figure 3:
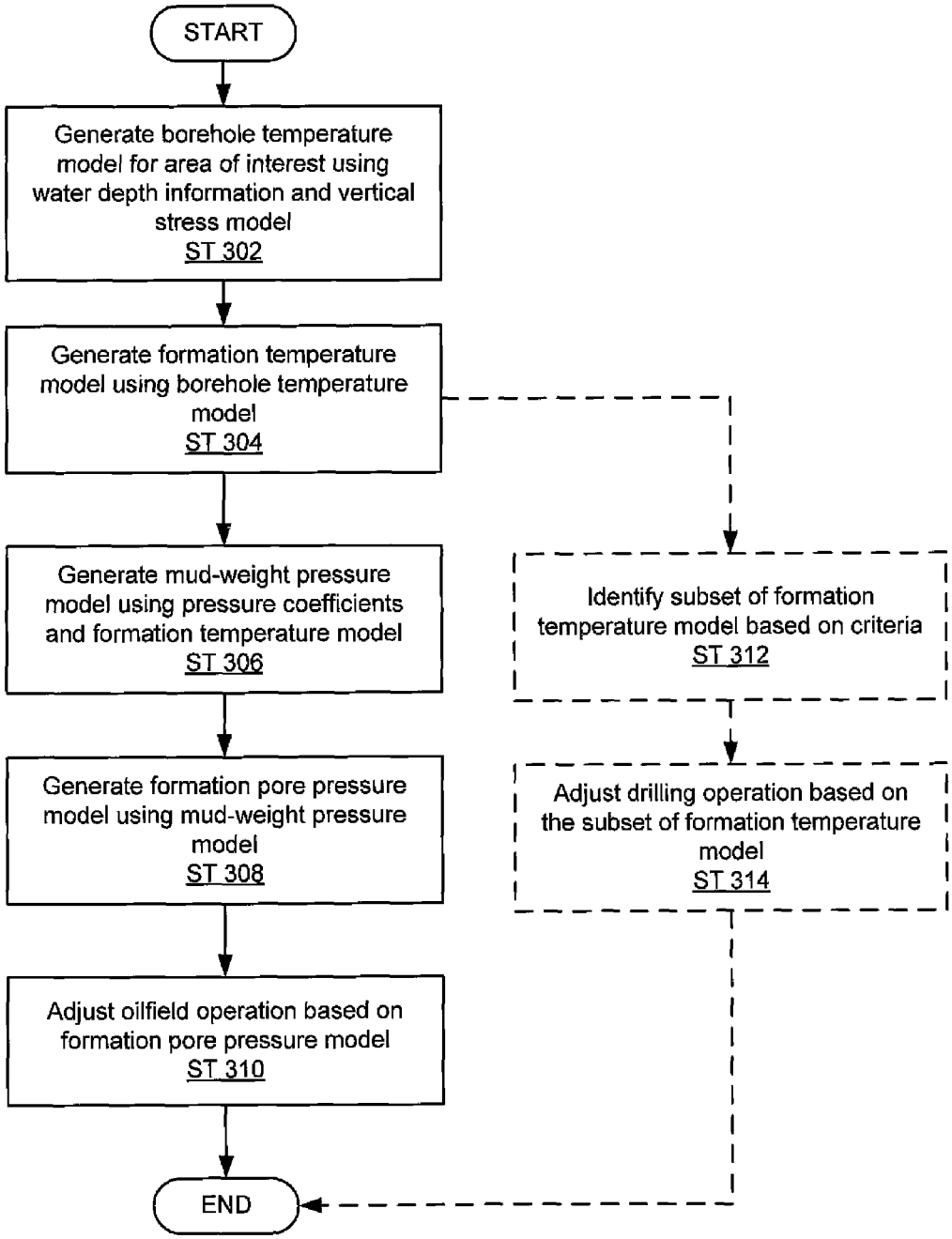
FIGS. 3-4 show flowcharts in accordance with one or more embodiments of the invention.

FIG. 3 shows a flow chart in accordance with one or more embodiments of the invention. Specifically, FIG. 3 shows a flow chart for generating a formation pore pressure model. In one or more embodiments of the invention, one or more of the steps described below may be omitted, repeated, and/or performed in a different order. Accordingly, the specific arrangement of steps shown in FIG. 3 should not be construed as limiting the scope of the invention.

Initially, a borehole temperature model for an area of interest is generated using water depth information and a vertical stress model (ST 302). Those skilled in the art will appreciate that the borehole temperature model may be generated using a variety of formulas. For example, borehole temperature ($T_b$) may be calculated using the following formula:

$$T_b(S_V, z_w) = S_V \sum_{n=0}^{Q} m_{Tn} \cdot (z_w)^n + \sum_{n=0}^{Q} b_{Tn} \cdot (z_w)^n \tag{1}$$

(Note that, in this and later equations of this form (e.g., equations 3 and 14), the first sum could have a different number of terms to the second. The equation could have been written with the first sum over Q terms and the second over Q' terms, where Q is not equal to Q') where $S_V$ is vertical stress, $z_w$ is water depth, $m_{Tn}$, and $b_{Tn}$ are temperature coefficients, and Q is the number of temperature coefficients. Those skilled in the art will appreciate that Q may be variable depending on the precision required for the temperature coefficients. For example, Q may be constant (i.e., 0), linear (i.e., 1), quadratic (i.e., 2), or some other dimension. In one or more embodiments of the invention, a borehole temperature may be calculated for each location in the area of interest to obtain the borehole temperature model. Alternatively, a borehole temperature may be calculated for a specific location or subset of the area of interest. The calculated borehole temperatures may then be used to obtain, for example by interpolation or by geostatistical methods, the formation temperature model.

Figure 4:
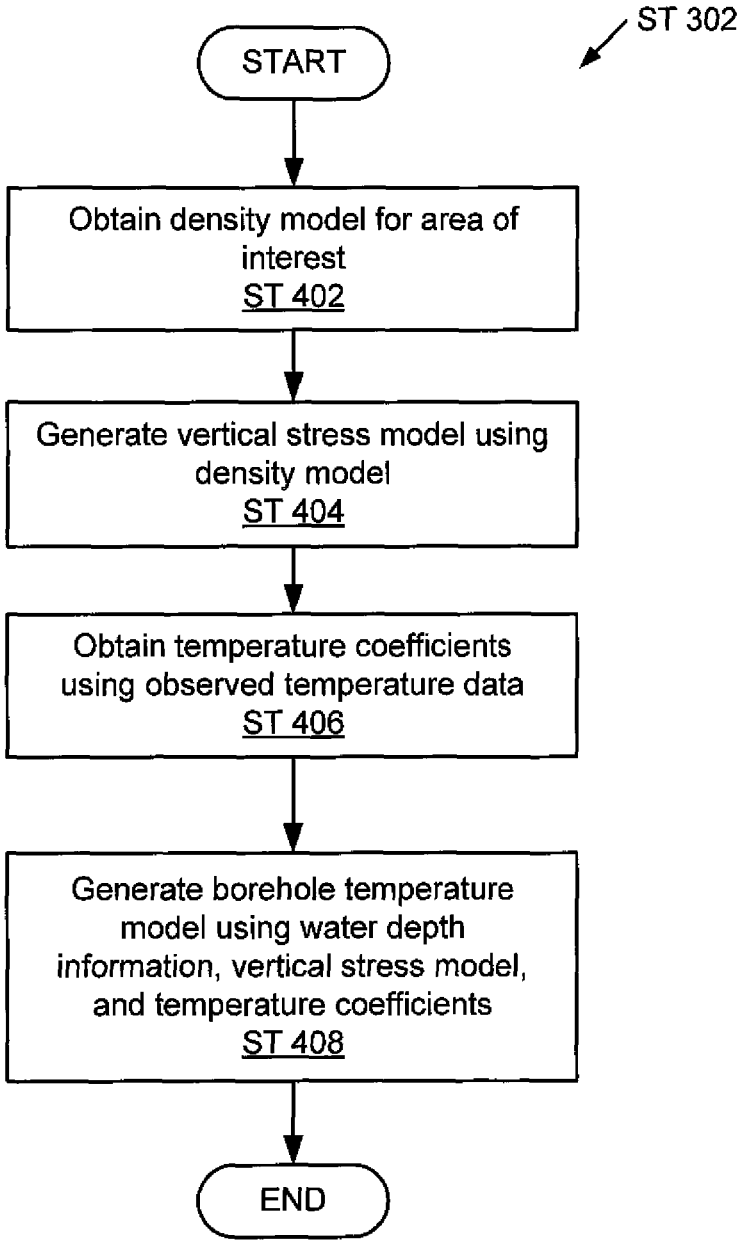

Alternatively, borehole temperature may also be calculated based on any parameter that varies systemically with respect to vertical stress. For example, borehole temperature may be calculated based on vertical depth below the mudline. In this case, $S_V$ may be replaced by vertical depth below the mudline in equation (1). One embodiment for generating the bore temperature model is shown in FIG. 4 below.

In ST 304, a formation temperature model is generated using the borehole temperature model. In one or more embodiments of the invention, formation temperature ($T_f$) may be calculated using the following formula:

$$T_f = T_b + \delta_T \tag{2}$$

where $T_b$ is borehole temperature and $\delta_T$ is the average temperature bias. For example, borehole temperatures are typically 10-20° F. lower than the formation temperature of virgin rock. Alternatively, formation temperature may be more accurately calculated using a Horner plot of borehole temperatures. In one or more embodiments of the invention, the formation temperature may be calculated for each location in the area of interest to obtain the formation temperature model. Alternatively, the formation temperature may be calculated for a specific location or subset of the area of interest. The calculated formation temperatures may then be used to obtain, for example by interpolation or by geostatistical methods, the formation temperature model.

In one or more embodiments of the invention, a mud-weight pressure model is generated using pressure coefficients and the formation temperature model (ST 306). Those skilled in the art will appreciate that the mud-weight pressure model may be generated using a variety of formulas. For example, mud-weight pressure (P) may be calculated using the following formula:

$$P(T_f, z_w) = T_f \sum_{n=0}^{R} m_{Pn} \cdot (z_w)^n + \sum_{n=0}^{R} b_{Pn} \cdot (z_w)^n \tag{3}$$

where $T_f$ is formation temperature, $z_w$ is water depth, $m_{Pn}$ and $b_{Pn}$ are pressure coefficients, and R is the number of pressure coefficients. Those skilled in the art will appreciate that R may be variable depending on the precision required for the pressure coefficients. For example, R may be constant (i.e., 0), linear (i.e., 1), quadratic (i.e., 2), or some other dimension. In one or more embodiments of the invention, a mud-weight pressure may be calculated for each location in the area of interest to obtain the mud-weight pressure model. Alternatively, a mud-weight pressure may be calculated for a specific location or subset of the area of interest. The calculated mud-weight pressures may then be used to obtain (for example, by interpolation) the mud-weight pressure model. Note that equation 3 will give pore pressure directly if the coefficients are determined by calibrating to pore pressure measurements (rather than mud weights) as can be measured using the Repeat Formation Tester (RFT), Modular Dynamics Formation Tester (MDT), Stethoscope tools of Schlumberger, or other similar tools.

In one or more embodiments of the invention, pressure coefficients are obtained using observed pore pressure data. For example, pressure coefficients may be obtained by applying a least-squares minimization of a root-mean square prediction error ($\xi_P$) defined by the following formula:

$$\xi_P = \left\{ \frac{1}{N} \sum_{k=1}^{N} [(\mu_{Pk} \cdot T_f + \beta_{Pk}) - P_k]^2 \right\}^{1/2} \tag{4}$$

where:

$$\mu_{Pk} = \sum_{n=0}^{R} m_{Pn} \cdot (z_{wk})^n \tag{5}$$

$$\beta_{Pk} = \sum_{n=0}^{R} b_{Pn} \cdot (z_{wk})^n \tag{6}$$

and where $\mu_{Pk}$ and $\beta_{Pk}$ are pressure coefficients, $S_{Vk}$ is the vertical stress at point k, and $P_k$ is the observed pore pressure at point k, and R is the number of pressure coefficients. Those skilled in the art will appreciate that R may be variable depending on the precision required for the pressure coefficients. For example, Q may be constant (i.e., 0), linear (i.e., 1), quadratic (i.e., 2), or some other dimension.

Those skilled in the art will appreciate that the observed pore pressure may be obtained by a variety of methods. For example, observed pore pressures at a location in an area of interest may be obtained using a MDT and/or an RFT.

Optionally, the pressure coefficients may be calibrated based on additional observed pore pressure data acquired during an oilfield operation (e.g., using Bayesian approach). In this case, the updated pressure coefficients may be based on a larger set of observed pore pressure data; therefore, the estimated mud-weight pressure calculated using, for example, equation (3) above may be more accurate.

Continuing with the discussion of FIG. 3, in ST 308, a formation pore pressure model is generated using the mud-weight pressure model. In one or more embodiments of the invention, formation pore pressure (p) may be calculated using the following formula:

$$p(z) = P(T_f, z_w) - \frac{\delta_p \cdot z}{19.25} \tag{7}$$

where $P(T_f, z_w)$ is mud-weight pressure, $\delta_P$ is the average pressure bias, and z is the subsurface vertical depth. In one embodiment of the invention, $\delta_P$ is within the range of 0.5 lb/gal-1 lb/gal. In one or more embodiments of the invention, a formation pore pressure may be calculated for each location in the area of interest to obtain the formation pore pressure model. Alternatively, a formation pore pressure may be calculated for a specific location or subset of the area of interest. The calculated formation pore pressures may then be used to obtain (for example, by interpolation) the formation pore pressure model.

In one or more embodiments of the invention, the formation pore pressure model may be used to adjust an oilfield operation (ST 310). In one or more embodiments of the invention, adjusting the oilfield operation may involve adjusting a drilling fluid density (i.e., increasing or decreasing the drilling fluid density, for example, mud weight density, as appropriate), adjusting a drilling trajectory (e.g., to avoid an overpressured area, to pass through a low-pressure area, etc.), optimizing the number of casing strings in the borehole (i.e., adding a casing string, delaying addition of a casing string, etc.), or any other similar type of adjustment. For example, the mud-weight density of an oilfield operation may be optimized based on the formation pore pressure model.

Optionally, in ST 312, a subset of the formation temperature model may be identified based on criteria. Those skilled in the art will appreciate that the criteria may specify a range of temperatures. For example, the criteria may specify a temperature from 150° F. to 200° F. In this example, the subset of the formation temperature model may correspond to a region with a higher likelihood of being overpressured.

In one or more embodiments of the invention, the oilfield operation may be adjusted based on the subset of the formation temperature model (ST 314). In one or more embodiments of the invention, adjusting the oilfield operation involves adjusting a drilling fluid density (i.e., increasing or decreasing the drilling fluid density, as appropriate), adjusting a drilling trajectory (e.g., to avoid an overpressured area, to pass through a low-pressure area, etc.), optimizing the number of casing strings in the borehole (i.e., adding a casing string, delaying addition of a casing string, etc.), or any other similar type of adjustment.

In one or more embodiments of the invention, the oilfield operation corresponds to a drilling operation (e.g., drilling a well), an exploration operation (e.g., locating producing reservoirs, locating regions which may have producing reservoirs, etc.), or a production operation (e.g., fluid extraction, completing a well, optimizing production of an existing well, etc.).

FIG. 4 shows a flow chart in accordance with one or more embodiments of the invention. Specifically, FIG. 4 shows a flow chart for generating a borehole temperature model. In one or more embodiments of the invention, one or more of the steps described below may be omitted, repeated, and/or performed in a different order. Accordingly, the specific arrangement of steps shown in FIG. 4 should not be construed as limiting the scope of the invention.

Initially, a density model for the area of interest may be generated using water depth information and observed density data (ST 402). Those skilled in the art will appreciate that the density model may be generated using a variety of formulas. For example, the sediment density (ρ) may be calculated using the following formula:

$$\rho = \rho_0 + a(z - z_w)^b \tag{8}$$

where $\rho_0$ is density at the seabed, $z_w$ is water depth, a and b are density coefficients, and z is the subsurface vertical depth (measured from sea surface (110 in FIG. 1) to subsurface location). In one or more embodiments of the invention, a density may be calculated for each location in the area of interest to obtain the density model. Alternatively, a density may be calculated for a specific location or subset of the area of interest to obtain the density model.

Equation 9 shows a version of equation 8 in accordance with one embodiment of the invention:

$$\rho_T(z) = \frac{16.3 + 1.6\left[\frac{(z - z_w)}{3125}\right]^{0.6}}{8.3454} [g/\mathrm{cm}^3] \tag{9}$$

where z is the subsurface vertical depth and $z_w$ is water depth. Those skilled in the art will appreciate that the density coefficients in equation (9) may be updated using additional observed density data (e.g., using a Bayesian approach). For more information on the Bayesian approach, refer to U.S. Pat. No. 6,826,486 entitled "Methods and apparatus for predicting pore and fracture pressures of a subsurface formation" with Alberto Malinverno listed as an inventor.

Those skilled in the art will appreciate that the density coefficients (e.g., a and b from equation (8)) may be obtained by inversion of observed density data (i.e., local calibration). Further, in one or more embodiments of the invention, the density model may be generated by using trend kriging, employing a relation in the form of equation (8), as a three-dimensional trend.

Continuing with the discussion of FIG. 4, in ST 404, a vertical stress model may be generated based on the density model. Those skilled in the art will appreciate that the vertical stress model may be generated using a variety of formulas. For example, vertical stress ($S_V$) may be calculated using the following formula:

$$S_V(z) = g\int_0^z \rho(z)dz \tag{10}$$

where z is the subsurface vertical depth and ρ is density. In one or more embodiments of the invention, a vertical stress may be calculated for each location in the area of interest to obtain the vertical stress model. Alternatively, a vertical stress may be calculated for a specific location or subset of the area of interest. The calculated formation vertical stresses may then be used to obtain, for example by interpolation or by geostatistical methods, the vertical stress model.

In one or more embodiments of the invention, temperature coefficients may be obtained using observed temperature data (ST 406). For example, temperature coefficients may be obtained by applying a least-squares minimization of a root-mean square prediction error ($\xi_T$) defined by the following formula:

$$\xi_T = \left\{ \frac{1}{N} \sum_{k=1}^{N} [(\mu_{Tk} \cdot S_{Vk} + \beta_{Tk}) - T_k]^2 \right\}^{1/2} \tag{11}$$

where:

$$\mu_{Tk} = \sum_{n=0}^{Q} m_{Tn} \cdot (z_{wk})^n \tag{12}$$

$$\beta_{Tk} = \sum_{n=0}^{Q} b_{Tn} \cdot (z_{wk})^n \tag{13}$$

and where $\mu_{Tk}$ and $\beta_{Tk}$ are temperature coefficients, $S_{Vk}$ is the vertical stress at point k, $T_k$ is the observed temperature at point k, and Q is the number of temperature coefficients. Those skilled in the art will appreciate that Q may be variable depending on the precision required for the temperature coefficients. For example, Q may be constant (i.e., 0), linear (i.e., 1), quadratic (i.e., 2), or some other dimension.

Optionally, the temperature coefficients may be updated based on additional observed temperature data acquired during an oilfield operation (e.g., a Bayesian approach). In this case, the updated temperature coefficients are based on a larger set of observed temperature data; therefore, the borehole temperature calculated using, for example, equation (13) below may be more accurate.

In ST 408, a borehole temperature model may be generated using water depth information, the vertical stress model, and the temperature coefficients. Those skilled in the art will appreciate that the borehole temperature model may be generated using a variety of formulas. For example, borehole temperature ($T_b$) may be calculated using the following formula:

$$T_b(S_V, z_w) = S_V \sum_{n=0}^{Q} m_{Tn} \cdot (z_w)^n + \sum_{n=0}^{Q} b_{Tn} \cdot (z_w)^n \tag{14}$$

where $S_V$ is vertical stress, $z_w$ is water depth, $m_{Tn}$, and $b_{Tn}$ are the temperature coefficients, and Q is the number of temperature coefficients. Those skilled in the art will appreciate that Q may be variable depending on the precision required for the temperature coefficients. For example, Q may be constant (i.e., 0), linear (i.e., 1), quadratic (i.e., 2), or some other dimension. In one or more embodiments of the invention, a borehole temperature may be calculated for each location in the area of interest to obtain the borehole temperature model. Alternatively, a borehole temperature may be calculated for a specific location or subset of the area of interest. The calculated borehole temperatures may then be used to obtain (for example, by interpolation) the borehole temperature model.

One or more embodiments of the invention provide a means for accurately predicting a formation pore pressure using vertical stress and water depth. Accordingly, one or more embodiments of the invention may prevent formation fluids from entering a borehole, thereby preventing damage to the well and/or personnel operating a drilling rig. Further, one or more embodiments of the invention may prevent the financial overhead of prematurely inserting casing strings. One or more embodiments of the invention have an important application in exploration of an oilfield and in grading various prospects. For example, a knowledge of pore pressure can be used to examine the effectiveness of seals, the sealing potential of faults, and the hydraulic connectivity of a sedimentary basin.

Figure 5:
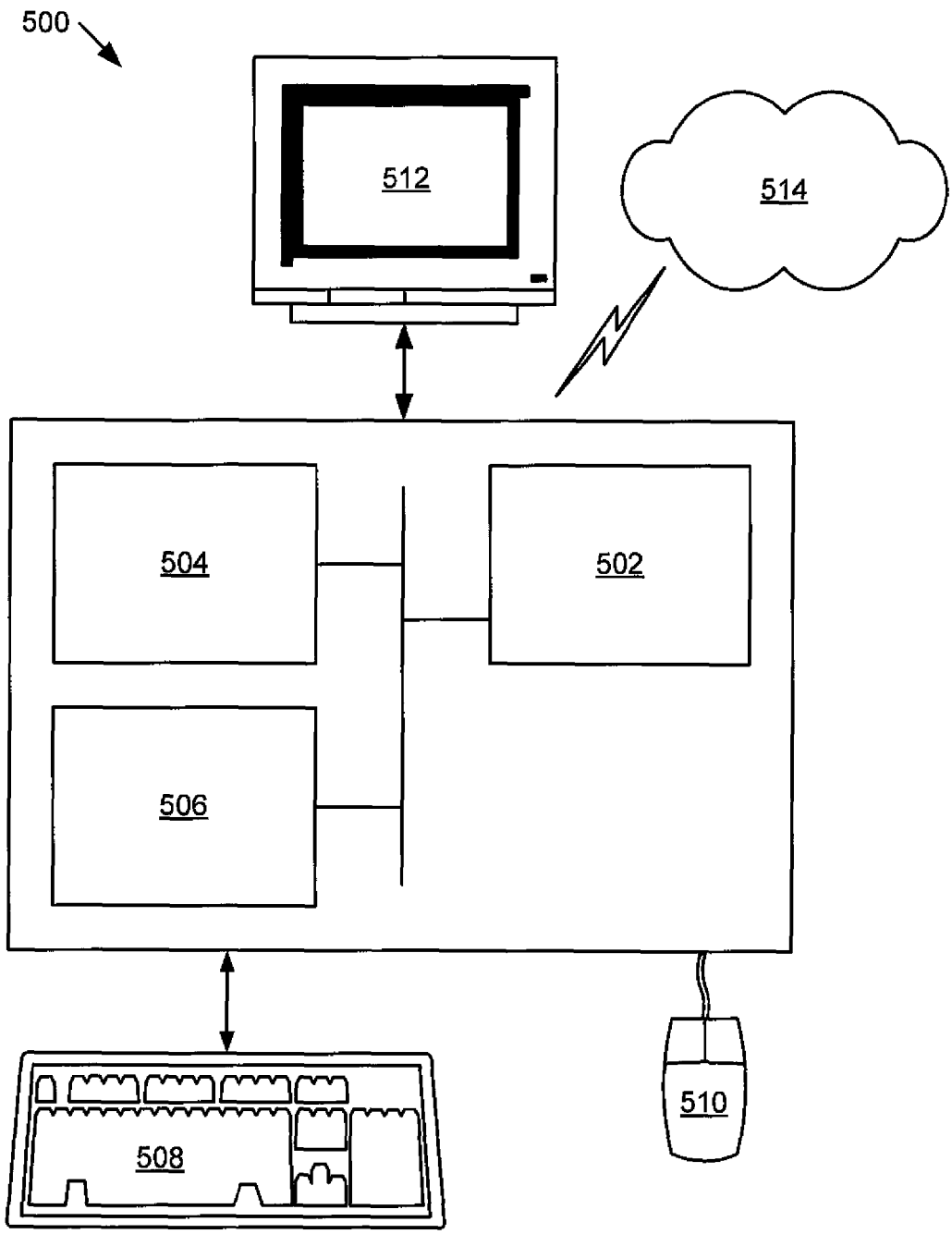
FIG. 5 shows a diagram of a computer system in accordance with one or more embodiments of the invention.

The invention may be implemented on virtually any type of computer regardless of the platform being used. For example, as shown in FIG. 5, a computer system (500) includes a processor (502), associated memory (504), a storage device (506), and numerous other elements and functionalities typical of today's computers (not shown). The computer (500) may also include input means, such as a keyboard (508) and a mouse (510), and output means, such as a monitor (512). The computer system (500) may be connected to a network (514) (e.g., a local area network (LAN), a wide area network (WAN) such as the Internet, or any other similar type of network) via a network interface connection (not shown). Those skilled in the art will appreciate that these input and output means may take other forms.

Further, those skilled in the art will appreciate that one or more elements of the aforementioned computer system (500) may be located at a remote location and connected to the other elements over a network. Further, the invention may be implemented on a distributed system having a plurality of nodes, where each portion of the invention (e.g., stress sensitivity coefficient module, total stress module, pore pressure module, etc.) may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, a file, or any other computer readable storage device. In addition, in one embodiment of the invention, the predicted pore pressure (including all the pore pressures calculated using the method described in FIG. 3) may be displayed to a user via a graphical user interface (e.g., a display device).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for predicting formation pore pressure, comprising:

generating a borehole temperature model by calculating estimated borehole temperatures for an area of interest using water depth information and a vertical stress model;

generating a formation temperature model by calculating estimated formation temperatures for the area of interest using the estimated borehole temperatures of the borehole temperature model;

generating a mud-weight pressure model by calculating mud-weight pressures for the area of interest using the formation temperatures of the formation temperature model and pressure coefficients;

generating a formation pore pressure model by calculating formation pore pressures for the area of interest using the mud-weight pressures of the mud-weight pressure model; and obtaining, using a processor, a proposed well plan based on the formation pore pressure model, wherein the proposed well plan is used to perform an oilfield operation.

2. The method of claim 1, wherein the oilfield operation is selected from at least one of a group consisting of an exploration operation, a drilling operation, and a production operation.

3. The method of claim 1, further comprising:

identifying a subset of the formation temperature model based on criteria; and using the subset of the formation temperature model to update the proposed well plan to obtain an updated proposed well plan, wherein the updated proposed well plan defines a well trajectory avoiding the subset of the formation temperature model.

4. The method of claim 3, wherein the criteria is a temperature range from 150 degrees Fahrenheit to 200 degrees Fahrenheit.

5. The method of claim 1, further comprising:

prior to said generating the borehole temperature model:

generating a density model for the area of interest by calculating estimated densities for the area of interest using the water depth information and observed density data;

generating the vertical stress model using the density model; and obtaining temperature coefficients using observed temperature data, wherein the temperature coefficients are additionally used to generate the borehole temperature model.

6. The method of claim 5, wherein generating the density model further comprises obtaining a three-dimensional trend based on the water depth information and the observed density data.

7. The method of claim 6, wherein obtaining the vertical stress model comprises integrating the density model.

8. The method of claim 6, wherein the three-dimensional trend is updated using trend kriging.

9. The method of claim 5, wherein obtaining the temperature coefficients further comprises applying a least-square minimization to a root-mean square estimate, wherein the root-mean square estimate is based on the vertical stress model and the observed temperature data.

10. The method of claim 5, wherein temperature data acquired during an oilfield operation is used to update the temperature coefficients to obtain updated temperature coefficients, wherein the updated temperature coefficients are used to obtain an updated borehole temperature model.

11. The method of claim 1, wherein the pressure coefficients are obtained by applying a least-square minimization to a root-mean square estimate, wherein the root-mean square estimate is based on the formation temperature model and observed pressure data.

12. The method of claim 1, wherein pressure data acquired during the oilfield operation is used to update the pressure coefficients to obtain updated pressure coefficients, wherein the updated pressure coefficients are used to obtain an updated mud-weight pressure model.

13. A modeling system, comprising:

a temperature module configured to:

generate a borehole temperature model by calculating estimated borehole temperatures for an area of interest using water depth information and a vertical stress model; and generate a formation temperature model by calculating estimated formation temperatures for the area of interest using the estimated borehole temperatures of the borehole temperature model;

a pressure module configured to:

generate a mud-weight pressure model by calculating mud-weight pressures for the area of interest using the formation temperatures of the formation temperature model and pressure coefficients; and generate a formation pore pressure model by calculating formation pore pressures for the area of interest using the mud-weight pressures of the mud-weight pressure model; and a modeling unit executing on a processor and configured to obtain a proposed well plan based on the formation pore pressure model, wherein the proposed well plan is used to perform an oilfield operation.

14. The system of claim 13, wherein the oilfield operation is at least one selected from a group consisting of an exploration operation, a drilling operation, and a production operation.

15. The system of claim 13, wherein:

the temperature module is further configured to identify a subset of the formation temperature model based on criteria; and the modeling unit is further configured to use the subset of the formation temperature model to update the proposed well plan to obtain an updated proposed well plan, wherein the updated proposed well plan defines a well trajectory avoiding the subset of the formation temperature model.

16. The system of claim 15, wherein the criteria is a temperature range from 150 degrees Fahrenheit to 200 degrees Fahrenheit.

17. The system of claim 13, further comprising:

a density module configured to generate a density model for the area of interest by calculating estimated densities for the area of interest using the water depth information and observed density data; and a stress module configured to generate the vertical stress model using the density model, wherein the temperature module is further configured to obtain temperature coefficients using observed temperature data, wherein the temperature coefficients are additionally used to generate the borehole temperature model.

18. The system of claim 17, wherein generating the density model further comprises obtaining a three-dimensional trend based on the water depth information and a calibration of the observed density data.

19. The system of claim 18, wherein obtaining the vertical stress model comprises integrating the density model.

20. The system of claim 18, wherein the three-dimensional trend is updated using trend kriging.

21. The system of claim 17, wherein obtaining the temperature coefficients further comprises applying a least-square minimization to a root-mean square estimate, wherein the root-mean square estimate is based on the vertical stress model and the observed temperature data.

22. The system of claim 17, wherein log temperature data acquired during the oilfield operation is used to update the temperature coefficients to obtain updated temperature coefficients, wherein the updated temperature coefficients are used to obtain an updated borehole temperature model.

23. The system of claim 13, wherein the pressure coefficients are obtained by applying a least-square minimization to a root-mean square estimate, wherein the root-mean square estimate is based on the formation temperature model and observed pressure data.

24. The system of claim 13, wherein log pressure data acquired during the oilfield operation is used to update the pressure coefficients to obtain updated pressure coefficients, wherein the updated pressure coefficients are used to obtain an updated mud-weight pressure model.

25. A non-transitory computer program product, embodying instructions executable by the computer to perform method steps for obtaining a proposed well plan, the instructions comprising functionality to:

generate a borehole temperature model by calculating estimated borehole temperatures for an area of interest using water depth information and a vertical stress model;

generate a formation temperature model by calculating estimated formation temperatures for the area of interest using the estimated borehole temperatures of the borehole temperature model;

generate a mud-weight pressure model by calculating mud-weight pressures for the area of interest using the formation temperatures of the formation temperature model and pressure coefficients;

generate a formation pore pressure model by calculating formation pore pressures for the area of interest using the mud-weight pressures of the mud-weight pressure model; and obtain the proposed well plan based on the formation pore pressure model, wherein the proposed well plan is used to perform an oilfield operation.

26. The computer program product of claim 25, the instructions further comprising functionality to:

identify a subset of the formation temperature model based on criteria; and adjust the oilfield operation based on the subset of the formation temperature model.

27. The computer program product of claim 26, wherein the criteria is a temperature range from 150 degrees Fahrenheit to 200 degrees Fahrenheit.

28. The computer program product of claim 25, the instructions further comprising functionality to:

prior to said generating the borehole temperature model:

generate a density model for the area of interest by calculating estimated densities for the area of interest using the water depth information and observed density data;

generate the vertical stress model using the density model; and obtain temperature coefficients using observed temperature data, wherein the temperature coefficients are additionally used to generate the borehole temperature model.

29. The computer program product of claim 28, wherein generating the density model further comprises obtaining a three-dimensional trend based on the water depth information and the observed density data.

30. The computer program product of claim 29, wherein obtaining the vertical stress model comprises integrating the density model.

31. The computer program product of claim 29, wherein the three-dimensional trend is updated using trend kriging.

32. The computer program product of claim 28, wherein obtaining the temperature coefficients further comprises applying a least-square minimization to a root-mean square estimate, wherein the root-mean square estimate is based on the vertical stress model and the observed temperature data.

33. The computer program product of claim 28, wherein temperature data acquired during the oilfield operation is used to update the temperature coefficients to obtain updated temperature coefficients, wherein the updated temperature coefficients are used to obtain an updated borehole temperature model.

34. The computer program product of claim 25, wherein the pressure coefficients are obtained by applying a least-square minimization to a root-mean square estimate, wherein the root-mean square estimate is based on the formation temperature model and observed pressure data.

35. The computer program product of claim 25, wherein pressure data acquired during the oilfield operation is used to update the pressure coefficients to obtain updated pressure coefficients, wherein the updated pressure coefficients are used to obtain an updated mud-weight pressure model.

* * * * *